US005766757A

United States Patent [19]

Tanaka et al.

[11] Patent Number: 5,766,757

[45] Date of Patent: Jun. 16, 1998

[54] BASIC GAS ABSORPTIVE FIBER AND PRODUCTION THEREOF

[75] Inventors: Koji Tanaka; Hideyuki Tsurumi; Yoko Yamamoto, all of Okayama, Japan

[73] Assignee: Japan Exlan Company Limited, Osaka, Japan

[21] Appl. No.: 884,322

[22] Filed: Jun. 27, 1997

Related U.S. Application Data

[63] Continuation of Ser. No. 573,140, Dec. 15, 1995, abandoned.

[30] Foreign Application Priority Data

Jan. 13, 1995 [JP] Japan ..... 7-021306

[51] Int. Cl.[6] ..... D02G 3/00; D06M 23/00; D01F 6/18; C08F 20/44

[52] U.S. Cl. ..... 428/364; 428/400; 264/182; 525/329.1; 8/115.65

[58] Field of Search ..... 428/364, 375, 428/400; 8/115.65; 525/329.1; 264/182

[56] References Cited

U.S. PATENT DOCUMENTS 5,292,827 3/1994 Tanaka et al. ..... 525/329.1

FOREIGN PATENT DOCUMENTS 1-299624 12/1989 Japan .
5-132858 5/1993 Japan .

OTHER PUBLICATIONS

Database WPI, Section Ch, Derwent Publications Ltd., London; Class A14, AN 72-73385T XP002019467 & SU-A-332 148 (Dorokhina is Zverev MP BA) *abstract* Nov. 1972.

*Primary Examiner*—Newton Edwards
*Attorney, Agent, or Firm*—Wenderoth, Lind & Ponack

[57] ABSTRACT

Disclosed herein is a fiber capable of basic gas absorption and easy regeneration. Disclosed also herein is a process for producing said fiber. The basic gas absorptive fiber is an acrylic fiber characterized by a specific amount of nitrogen which is increased by crosslinking with hydrazine, a specific amount of carboxyl groups and amido groups resulting from modification of nitrile groups, and a specific value of tensile strength. It is prepared from acrylic fiber by crosslinking with hydrazine and subsequent hydrolysis and conversion of hydroxyl groups into carboxylic acid. It has good processability and can be used repeatedly.

3 Claims, 1 Drawing Sheet

BASIC GAS ABSORPTIVE FIBER AND PRODUCTION THEREOF

This application is a continuation of Ser. No. 08/573,140 filed Dec. 15, 1995, now abandoned.

BACKGROUND OF THE INVENTION

1. Field of the Invention

The present invention relates to a basic gas absorptive fiber and also to a process for production thereof, said fiber being capable of absorbing and releasing a basic gas reversibly, rapidly, and repeatedly.

2. Description of the Prior Art

Problems with offensive odors are developing in keeping with the recent change in life style and the increasingly crowded living environment. Typical among offensive odors are hydrogen sulfide, methyl mercaptan, and basic gases such as ammonia and trimethylamine.

There are known several kinds of deodorizing fibers, such as the one which has a deodorizing substance fixed onto the fiber surface and the one which is made of activated carbon. The former has a problem with durability and hand, and the latter has a disadvantage of being expensive and poor in deodorizing ammonia and requiring a high temperature for regeneration or requiring a special chemical for chemical regeneration. Deodorizing fibers for basic gases usually utilize the neutralization reaction for deodorizing. However, those which are produced by treating the fiber with a substance that takes part in neutralization does not possess a high deodorizing capacity. Deodorizing fibers can also be made by introduction of functional groups into fiber molecules. An example is acrylic fiber into which carboxyl groups are introduced. A disadvantage of this technique is that the resulting fiber becomes poor in mechanical properties in proportion to the amount of functional groups introduced. Thus, there is no deodorizing fiber which has both good mechanical properties and high deodorizing capacity.

SUMMARY OF THE INVENTION

It is an object of the present invention to provide a basic gas absorptive fiber and a process for production thereof, said fiber being capable of absorbing a large amount of basic gas rapidly, being easy to handle, being capable of regeneration with ease, and having good mechanical properties necessary for processing into various forms.

The first aspect of the present invention resides in a basic gas absorptive fiber characterized in that said fiber is of crosslinked acrylic polymer and is 1.0–8.0% by weight in the increase in nitrogen content due to crosslinking by hydrazine, there being introduced carboxyl groups in an amount of 2.0–6.0 m mol/g into a part of the remaining nitrile groups and being introduced amido groups into the remainder of the remaining nitrile groups, and the tensile strength of said fiber is 1 g/d or more.

The second aspect of the present invention resides in a process for producing a basic gas absorptive fiber characterized in that acrylic fiber is subjected to the treatment with hydrazine to introduce crosslinking bond so that the increase in the nitrogen content is 1.0–8.0% by weight, and then subjected to hydrolysis so that carboxyl groups are introduced in an amount of 2.0–6.0 m mol/g into the remaining nitrile groups and amido groups are introduced into the remainder of the remaining nitrile groups.

DETAILED DESCRIPTION OF THE INVENTION

Figure 1:
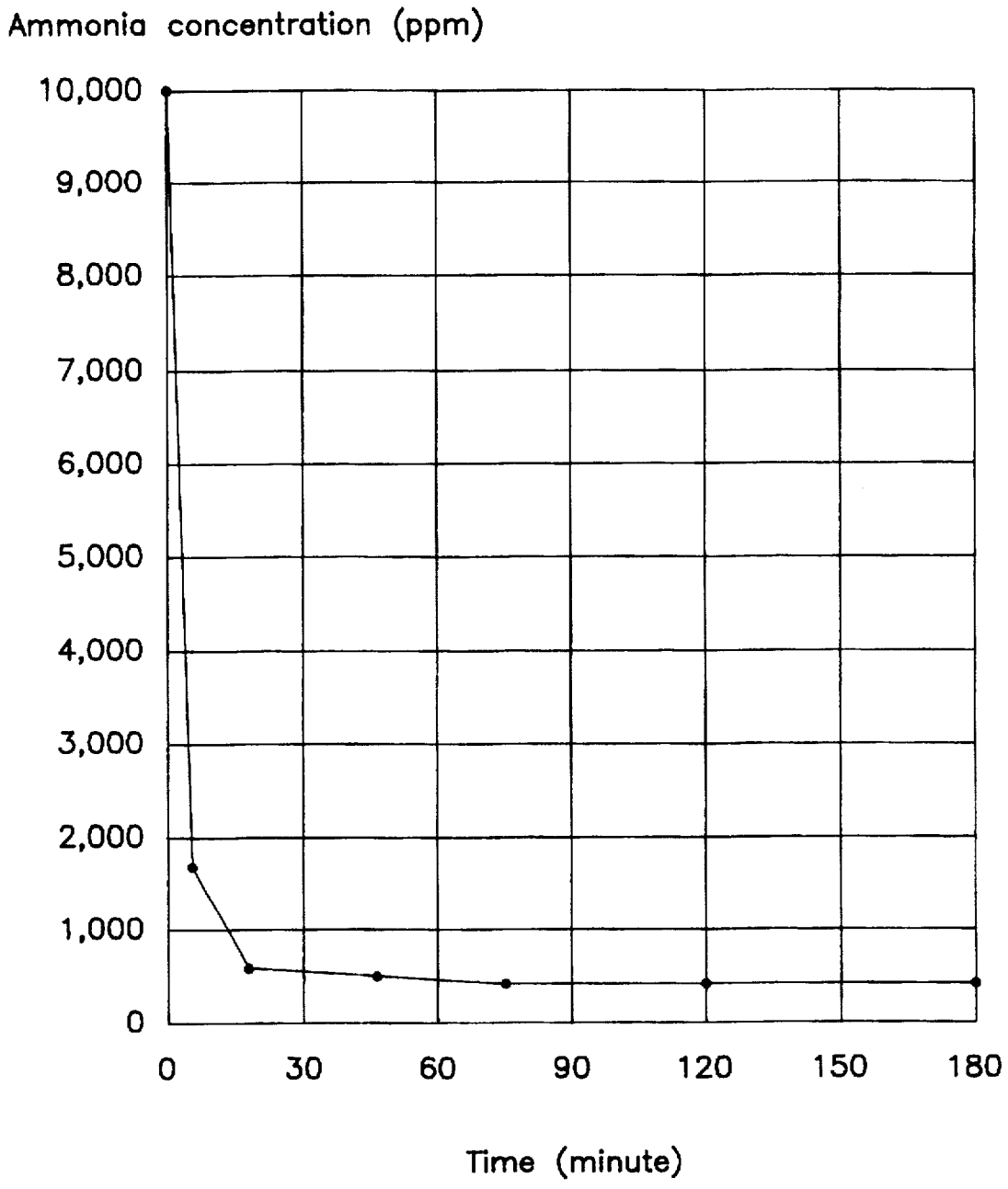
FIG. 1 is a graph showing the rate of ammonia absorption by the fiber of the present invention. The absorption rate is expressed in terms of the ammonia concentration in the sample gas versus the elapsed time.

The basic gas absorptive fiber of the present invention is based on an acrylic fiber prepared from an acrylonitrile polymer containing more than 40 wt %, preferably more than 50 wt %, of acrylonitrile. The acrylic fiber may be in the form of staple, tow, yarn, woven fabric, or non-woven fabric. It may also be an intermediate product or waste fiber. The acrylonitrile polymer may be a homopolymer or a copolymer. Examples of the comonomer include vinyl halide, vinylidene halide, (meth)acrylic ester, sulfonic acid-containing monomer and salt thereof (such as methallylsulfonic acid and p-styrenesulfonic acid), carboxylic acid-containing monomer and salt thereof (such as (meth)acrylic acid and itaconic acid), acrylamide, styrene, and vinyl acetate. The acrylic fiber as the starting material may be produced by any known process which is not specifically limited.

The process of the present invention starts with treating the above-mentioned acrylic fiber with hydrazine for crosslinking. This step may be carried out in any way so long as the crosslinking increases the nitrogen content in the acrylic fiber by 1.0–8.0 wt %. It is desirable for industrial production to use hydrazine in the form of 6–80 wt % aqueous solution and to carry out the treatment at 50°–120° C. for 1–5 hours.

The increase in nitrogen content means the difference between the nitrogen content in the acrylic fiber as the starting material and the nitrogen content in the acrylic fiber crosslinked with hydrazine. If the increase in nitrogen content is lower than the above-mentioned lower limit, the resulting product will not have practical physical properties. If the increase in nitrogen content exceeds the above-mentioned upper limit, the resulting product will not have the desired gas absorbing capacity. Conditions for these requirements can be experimentally established with ease by investigating the effect of reaction temperature, concentration, and time on the increase in nitrogen content.

Examples of the hydrazine that can be used in the present invention include hydrazine hydrate, hydrazine sulfate, hydrazine hydrochloride, and hydrazine bromate.

The above-mentioned crosslinking step is followed by hydrolysis. This hydrolysis is carried out such that the nitrile groups remaining uncrosslinked are substantially eliminated. As the result, there are introduced 2.0–6.0 in mol/g of carboxyl groups into a part of the nitrile groups and are introduced amido groups into the remainder of the nitrile groups. This step may be accomplished by heat-treating (impregnation or dipping) the crosslinked acrylic fiber with a basic aqueous solution of alkali metal hydroxide or ammonia or with an acid aqueous solution of nitric acid, sulfuric acid, or hydrochloric acid. Conditions for the requirement that the amount of carboxyl groups be 2.0–6.0 m mol/g can be experimentally established with ease by investigating the effect of reaction temperature, concentration, and time on the amount of carboxyl groups. Incidentally, it is also possible to perform hydrolysis simultaneously with the above-mentioned step of crosslinking.

In the case of hydrolysis with a base, it is necessary to convert the carboxyl group into carboxylic acid. This may be accomplished by dipping the hydrolyzed fiber in an acid aqueous solution of hydrochloric acid, acetic acid, nitric acid, or sulfuric acid, followed by drying.

With an amount of carboxyl groups smaller than the above-mentioned lower limit, the resulting product is poorer in absorbing capacity than activated carbon, which is a typical deodorizer. With an amount of carboxyl groups larger than the above-mentioned upper limit, the resulting product does not have of practical physical properties.

The above-mentioned steps yield a fiber having a tensile strength higher than 1 g/d and being capable of rapidly absorbing basic gases in large quantities. The fiber is also capable of regeneration with ease as mentioned later. The absorption of basic gases is a reversible reaction, and hence the absorbed gas is released when the fiber is exposed to clean air. (The amount of gas absorption per unit weight of the fiber is proportional to the concentration of gas in the atmosphere.) In other words, the gas absorbing capacity of the fiber is easily recovered.

The basic gas absorptive fiber will have a high tensile strength if it is prepared from an acrylic fiber with a high dichroism ratio (which is mentioned later).

It is preferable in the light of equipment, safety and uniform reaction, etc. that the process of the present invention be carried out by using a reaction vessel equipped with a pump for circulation in which the above-mentioned crosslinking and hydrolysis are performed sequentially. Such an apparatus is exemplified by an over maier dyeing machine.

For the resulting fiber to have good physical properties for practical use and a high gas absorbing capacity, it is necessary to use an acrylic fiber (as the starting material) specified below. That is, the acrylic fiber should be made of a highly oriented acrylonitrile polymer which is characterized by the congo red dichroism ratio greater than 0.4, preferably greater than 0.5. The congo red dichroism ratio is determined by the method described in "Kobunshi Kagaku" 23 (252) 193 (1966).

The acrylic fiber as the starting material can be prepared in any manner by using any existing apparatus so long as it has the above-specified congo red dichroism ratio. An industrially preferred example is one which has a total draw ratio greater than 6, preferably greater than 8, and a shrinkage percentage (in process) smaller than 30%, preferably smaller than 20%.

The acrylic fiber that can be used as the stating material may be one which has been oriented but has not yet undergone heat treatment. (Such acrylic fiber is produced in the usual way by spinning from a spinning dope of acrylonitrile polymer. It is oriented but is not heat-treated for dry-heat densification and wet-heat relaxation. A preferred example is one which is produced by dry spinning or dry/wet spinning and is in the water-swollen gel-like state after orientation, with the degree of water-swelling being 30–150%). It is easily dispersed into the reaction solution and is easily impregnated with the reaction solution, so that it permits rapid crosslinking and hydrolysis. Incidentally, the degree of water swelling is the quantity of water (in percent) contained in or attached to the fiber (on dry basis).

The basic gas absorptive fiber produced as mentioned above according to the present invention has a high gas-absorbing capacity. A probable reason for this is as follows although no thorough elucidation has been made.

Although the fiber pertaining to the present invention is produced from an acrylonitrile polymer, it has substantially no nitrile groups. This suggests that side chains connected to the polymer chains constitute the crosslink structure containing nitrogen resulting from reaction with hydrazine and are the carboxyl groups formed by hydrolysis of nitrile groups. The ability of the fiber to absorb basic gases originates in these carboxyl groups which combine with basic gases through acid-base reaction. Since this acid-base reaction is reversible, the gas-absorbing capacity of the fiber is easily recovered. In addition, although the fiber has no nitrile groups essential for fiber forming but has carboxyl groups instead, it still has good physical properties owing to the crosslink structure. The processability of the fiber is due to orientation characterized by the congo red dichroism.

EXAMPLES

The invention will be described in more detail with reference to the following examples. Percent in examples is based on weight, unless otherwise stated. Experiments on gas absorption were carried out under the atmospheric pressure (1 atm).

The following methods were used to determine the amount of carboxyl groups and the capacity of basic gas absorption.

(1) Amount of carboxyl groups (mmol/g)

Approximately one gram of completely dried sample is accurately measured. 200 ml of water is added to the sample. After heating to 50° C., the solution is adjusted to pH 2 with 1N aqueous solution of hydrochloric acid. The solution is titrated with 0.1N aqueous solution of sodium hydroxide in the usual way to give a titration curve. The amount of the aqueous solution of sodium hydroxide consumed for carboxyl groups is obtained from the titration curve, and the amount of carboxyl groups is calculated from the following equation.

Amount of carboxyl groups (mmol/g)=0.1×B/A where A is the amount (g) of the sample taken, and B is the amount (cc) of the aqueous solution of sodium hydroxide consumed for carboxyl groups.

(2) Basic gas absorbing capacity

A prescribed amount of dried fiber sample is placed in a container of prescribed volume and conditioned at 20° C. and 65 %RH. A basic gas of prescribed concentration is introduced into the container, and the sample is allowed to stand for 2 hours at 20° C. and 65 %RH in the closed container. The gas concentration in the container is measured by using a gas detecting tube or by the method mentioned later. The gas absorbing capacity is calculated from the difference between the initial gas concentration and the residual gas concentration.

The concentration of ammonia gas is measured as follows: A gas sample is taken from the container, and the gas sample is shaken with water so that ammonia in the gas sample is dissolved in water. The resulting aqueous solution is titrated with 0.01N hydrochloric acid. The concentration of ammonia gas is calculated from the equation below.

$$\text{Concentration of ammonia (ppm)}=D\times V/C\times 10^4$$

where

C is the amount (ml) of the gas sample taken,

D is the amount (cc) of the aqueous solution of 0.01N hydrochloric acid consumed for titration, and V is the volume (liter) of one mol of the gas at the measuring temperature.

Example 1

An acrylonitrile polymer composed of 90% acrylonitrile and 10% methyl acrylate was prepared. (It has an intrinsic viscosity [η] of 1.2 measured in dimethylformamide at 30° C.) Ten parts of the acrylonitrile polymer was dissolved in 90 parts of 48% aqueous solution of sodium thiocyanate to give a spinning dope. Spinning was carried out in the usual way, which was followed by drawing (with a total draw ratio of 10). The resulting fiber was dried in the atmosphere (with a dry-bulb temperature of 120° C. and a wet-bulb temperature of 60° C.). During drying, the fiber underwent 14% shrinkage. Thus there was obtained a fiber sample (designated as I) having a monofilament fineness of 1.5 d and a congo red dichroism ratio of 0.58.

This fiber I (as the starting material) underwent hydrazine treatment and hydrolysis under the conditions shown in Table 1. The treated fiber was immersed in 1N aqueous solution of hydrochloric acid for 30 minutes, followed by dehydration, water washing, and drying. Thus there were obtained fiber samples Nos. 1 to 7.

The characteristic properties of the fiber samples are shown in Table 1. The basic gas absorbing capacities of the fiber samples are shown in Table 2. The measuring conditions are as follow:

Ammonia

Initial gas concentration: 2000 ppm

Weight of fiber sample: 0.3 g

Volume of container used: 1400 ml

Trimethylamine

Initial gas concentration: 100 ppm

Weight of fiber sample: 6 g

Volume of container used: 3 liters

TABLE 1

| | Sample | Hydrazine treatment | | | NaOH treatment | | | Increase in nitrogen | Amount of carboxyl groups | Tensile strength |
|---|---|---|---|---|---|---|---|---|---|---|
| | No. | % | °C. | hr | % | °C. | hr | amount (%) | (mmol/g) | (g/d) |
| Example 1 | 1 | 35 | 103 | 3 | 10 | 90 | 2 | 4.2 | 4.8 | 1.7 |
| | 2 | 7 | 110 | 5 | 5 | 90 | 2 | 2.3 | 4.2 | 1.3 |
| | 3 | 80 | 55 | 5 | 8 | 90 | 2 | 1.0 | 5.8 | 1.0 |
| | 4 | 70 | 120 | 3 | 10 | 105 | 3 | 7.8 | 2.1 | 2.0 |
| Comparative Example | 5 | 35 | 45 | 5 | 10 | 90 | 2 | 0.7 | 6.1 | 0.8 |
| | 6 | 35 | 103 | 3 | 5 | 80 | 2 | 4.2 | 1.7 | 2.4 |
| | 7 | 35 | 125 | 3 | 10 | 105 | 3 | 8.3 | 1.9 | 2.2 |

TABLE 2

| Example | Fiber No. | Amount of carboxyl groups (mmol/g) | Gas concentration (ppm) 2 hours later | |
|---|---|---|---|---|
| | | | Ammonia | Trimethylamine |
| Example 1 | 1 | 4.8 | no detected | 48 |
| | 2 | 4.2 | no detected | 49 |
| | 3 | 5.8 | no detected | 46 |
| | 4 | 2.1 | 510 | 62 |
| Comparative Example | 5 | 6.1 | not detected | 34 |
| | 6 | 1.7 | 730 | 68 |
| | 7 | 1.9 | 630 | 65 |
| Referential Example (activated carbon) | | — | 520 | — |

It is noted from Table 1 and 2 that the fiber same Nos. 1 to 4 are superior in both basic gas absorbing capacity and physical properties. By contrast, the fiber sample No. 5 (for comparison), which is comparatively low in the increase of nitrogen content by hydrazine treatment, has a gas high basic gas absorbing capacity but is so poor in physical properties (with a tensile strength of 0.8 g/d) that is not capable of carding. The fiber sample No. 6 (for comparison), which is not hydrolyzed completely, has a low basic gas absorbing capacity owing to the low content of carboxyl groups. Similarly, the fiber sample No. 7 (for comparison), which is not hydrolyzed sufficiently due to excessive crosslinking, has a low basic gas absorbing capacity owing to the low content of carboxyl groups.

Example 2

The fiber sample No. 1 obtained in Example 1 was tested for the ammonia absorbing rate by measuring the concentration of ammonia gas which changed with time. The test conditions are as follows:

Weight of fiber sample: 0.3 g

Initial concentration of ammonia: 10000 ppm

Volume of the container: 1400 ml

Temperature: 20° C.

Relative humidity: 65%

The results are graphically shown in FIG. 1. It is noted that the concentration of ammonia in the container levels off after 20 minutes. This suggests a high absorbing rate.

Example 3

The fiber sample No. 1 obtained in Example 1 was tested for ammonia absorption and desorption (regeneration) by repeating three times the cycle of ammonia absorption (as in Example 1) and exposure to the sun for 3 hours. The test conditions are as follows:

Weight of fiber sample: 0.46 g

Initial concentration of ammonia: 44000 ppm

Volume of the container: 1400 ml

The results are shown in Table 3 below.

TABLE 3

| Number of repetitions of regeneration | Amount of ammonia absorbed (ml/g-fiber) | Ratio of regeneration (%) |
|---|---|---|
| 0 | 125 | — |
| 1 | 98 | 78 |
| 2 | 99 | 79 |
| 3 | 98 | 78 |

It is noted that the gas absorbing capacity decreases to about 80% after the first cycle of regeneration but it remains the same after the subsequent cycles of regeneration. It is also noted that the gas absorbing capacity is easily recovered by exposure to the sun.

Example 4

A fiber sample (designated as II), having a congo red dichroism ratio of 0.55, was prepared in the same manner as in Example 1, except that the methyl acrylate was replaced by vinylidene chloride. The fiber sample was treated in the same manner as in Example 1. The following results were obtained.

Increase of nitrogen content: 4.0%

Amount of carboxyl groups: 4.8 mmol/g

Tensile strength: 1.6 g/d

Concentration of ammonia in the container after absorption: not detected

Concentration of trimethylamine in the container after absorption: 49 ppm

These results indicate that the sample fiber (II) is superior in both physical properties and basic gas absorbing capacity.

[Effect of the invention]

The present invention provides a basic gas absorptive fiber which has a good gas absorbing capacity as well as good physical properties for practical use. The present invention also provides a process for industrially producing said fiber. Said fiber absorbs 30–100 g of ammonia per kg of its weight.

The basic gas absorptive fiber mentioned above is easily regenerated after absorption while it is allowed to stand in clean air. Therefore, it can be used repeatedly. In addition, it can be formed into woven fabric, non-woven fabric, knitted fabric, etc. which suit its application.

What is claimed is:

1. A basic gas absorptive and releasing fiber which comprises a crosslinked acrylic fiber prepared from an acrylonitrile polymer and has a 1.0–8.0% by weight increase in nitrogen content due to crosslinking by hydrazine, there being introduced carboxylic acid in an amount of 2.0–6.0 m mol/g into a part of the remaining nitrile groups and being introduced amido groups into the remainder of the remaining nitrile groups, and the tensile strength of said fiber is 1 g/d or more.

2. A process for producing the fiber of claim 1, which comprises subjecting an acrylic fiber to treatment with hydrazine to introduce crosslinking bonds so that the increase in the nitrogen content is 1.0–8.0% by weight, and then subjecting the fiber to hydrolysis so that carboxylic acid is introduced in an amount of 2.0–6.0 m/mol/g into the remaining nitrile groups and amido groups are introduced into the remainder of the remaining nitrile groups.

3. The fiber as claimed in claim 1, which has a congo red dichroism ratio greater than 0.4, and ammonia absorbability of 30–100 g of ammonia per kg of fiber weight.

* * * * *